United States Patent [19]

Biasi

[11] Patent Number: 5,035,068

[45] Date of Patent: Jul. 30, 1991

[54] SHOE AND REMOVABLE SHOE INSOLE SYSTEM

[75] Inventor: Franco A. Biasi, Lake Wylie, S.C.

[73] Assignee: The Wind Pro Corporation, Cincinnati, Ohio

[21] Appl. No.: 434,930

[22] Filed: Nov. 9, 1989

[51] Int. Cl.[5] ..... A43B 7/06; A43B 13/38

[52] U.S. Cl. ..... 36/3 R; 36/43; 36/44

[58] Field of Search ..... 36/3 R, 3 B, 43, 44, 36/115, 29, 71; 128/588, 594

[56] References Cited

U.S. PATENT DOCUMENTS

| | | | |
|---|---|---|---|
| 895,950 | 8/1908 | Bracht | 36/3 B |
| 1,103,874 | 7/1914 | Halley . | |
| 2,266,476 | 12/1941 | Riess | 36/3 |
| 2,344,762 | 3/1944 | Wylie | 36/3 |
| 2,435,131 | 1/1948 | Desbiens | 36/3 |
| 2,441,879 | 5/1948 | Gantt | 36/3 |
| 2,558,973 | 7/1951 | Meaker | 36/3 |
| 2,720,041 | 10/1955 | Kajtar | 36/3 |
| 2,751,692 | 6/1956 | Cortina | 36/3 |
| 2,887,793 | 5/1959 | Starr | 36/3 |
| 3,012,342 | 12/1961 | Ramirez | 36/3 |
| 3,027,659 | 4/1962 | Gianola | 36/3 |
| 3,044,188 | 7/1962 | Evangelista | 36/3 |
| 3,225,463 | 12/1965 | Burnham | 36/3 |
| 3,256,621 | 6/1966 | Linton | 36/3 |
| 3,273,264 | 9/1966 | Farinello | 36/3 |
| 3,310,887 | 10/1964 | Stokis | 36/3 |
| 3,331,146 | 7/1967 | Karras | 36/3 |
| 3,383,782 | 5/1968 | McGinnity | 36/3 |
| 3,426,455 | 2/1969 | Drago | 36/3 |
| 3,475,836 | 11/1969 | Brahm | 36/3 |
| 3,624,930 | 12/1971 | Johnson et al. | 36/3 |
| 3,973,336 | 8/1976 | Ahn | 36/3 B |
| 4,078,321 | 3/1978 | Famolare | 36/3 |
| 4,100,685 | 7/1978 | Dassler | 36/3 |
| 4,137,653 | 2/1979 | Famolare | 36/3 |
| 4,224,746 | 9/1980 | Kim | 36/3 |
| 4,233,758 | 10/1980 | Auberry | 36/3 |
| 4,364,186 | 12/1982 | Fukuoka | 36/3 |
| 4,408,401 | 10/1983 | Seidel et al. | 36/3 |

(List continued on next page.)

FOREIGN PATENT DOCUMENTS

| | | | |
|---|---|---|---|
| 806647 | 5/1952 | Austria | 36/29 |
| 0100067 | 8/1984 | European Pat. Off. | 36/43 |
| 854986 | 4/1940 | France . | |
| 1024960 | 4/1953 | France . | |
| 1310482 | 10/1962 | France | 36/3 R |
| 2109206 | 5/1972 | France . | |
| 2515938 | 11/1981 | France . | |
| 2614510 | 4/1987 | France . | |
| 566195 | 8/1957 | Italy | 36/3 R |
| 8402839 | 1/1986 | Netherlands | 36/43 |

OTHER PUBLICATIONS

Advertisement-Leonard L. Taicher's Shoes.
French Advertisement-TBS Products.

*Primary Examiner*—Daniel P. Stodola
*Assistant Examiner*—John P. Darling
*Attorney, Agent, or Firm*—Frost & Jacobs

[57] ABSTRACT

There is provided a removable insole for insertion into a shoe, including a substantially impervious flexible base having an overall anatomical shape and an outer periphery. The base further includes a plurality of upwardly extending compressible support columns each having a central axis and being attached at its lower end to the base. The upper ends of the compressible support columns remain substantially free and unattached. An anatomical pad having a top surface and a bottom surface, and substantially conforming to the peripheral shape of the base is attached by its bottom surfacae to the outer periphery of the base. The pad is, thereby, effectively spaced from the base by the support columns to form a compressible chamber therebetween. In a preferred embodiment, the support columns are free to independently compress vertically along their central axes and to move laterally in directions normal to such vertical compression, thereby providing a massaging or stimulation action to the lower portions of the wearer's foot. The subject insole/shoe system can also provide optional deodorant and/or anti-fungal features.

16 Claims, 5 Drawing Sheets

U.S. PATENT DOCUMENTS

| | | | |
|---|---|---|---|
| 4,420,893 | 12/1983 | Stephan | 36/3 |
| 4,438,573 | 3/1984 | McBarron | 36/3 |
| 4,445,284 | 5/1984 | Sakutori | 36/3 |
| 4,499,672 | 2/1985 | Kim | 36/3 |
| 4,507,880 | 4/1985 | Ohashi | 36/115 |
| 4,602,441 | 7/1986 | El Sakkaf | 36/3 |
| 4,633,597 | 1/1987 | Shiang | 36/43 |
| 4,654,982 | 4/1987 | Lee | 36/3 |
| 4,742,625 | 5/1988 | Sydor et al. | 36/3 |
| 4,760,651 | 8/1988 | Pon-Tzu | 36/3 |
| 4,776,110 | 10/1988 | Shiang | 36/3 |
| 4,813,160 | 3/1989 | Kuznetz | 36/3 |
| 4,823,799 | 4/1989 | Robbins | 36/44 X |
| 4,837,948 | 6/1989 | Cho | 36/3 |

SHOE AND REMOVABLE SHOE INSOLE SYSTEM

TECHNICAL FIELD

This invention relates to a shoe with removable insole system which provides improved comfort, support, and overall performance of all types of shoes and, more particularly, to an interchangeable insole/shoe system which provides improved comfort and support, wherein the structure of the removable insole is also designed to simultaneously encourage improved blood circulation and perfusion characteristics to a wearer's foot, with optional ventilation, deodorization, and anti-fungus features.

BACKGROUND ART

The skin of the human foot exudes perspiration, as well as odors, in varying degrees, depending upon such factors as temperature of the ambient, the amount of physical activity being performed, and the natural propensity of the particular person to perspire. The comfort and health of the human foot is greatly influenced by the rate of evaporation of the perspiration generated as a result of movement and/or physical exercise. Moreover, it is common for any type of shoe to develop malodorous characteristics with use; a problem which has been acknowledged and addressed with varying degrees of failure in a plethora of ways over the years.

In particular, a number of attempts have been implemented to provide ventilated footwear to enhance both comfort and to obviate the odors commonly associated with shoes and related footwear. For example, U.S. Pat. Nos. 3,012,342 (which issued to E. Ramirez on Dec. 12, 1961, U.S. Pat. No. 4,438,537 (which issued to G. McBarron on Mar. 27, 1984), U.S. Pat. No. 4,499,672 (which issued to S. Kim on Feb. 19, 1985), U.S. Pat. No. 4,654,982 (which issued to K. Lee on Apr. 7, 1987), and U.S. Pat. No. 4,813,160 (which issued to L. Kuznetz on Mar. 21, 1989) illustrate and describe various forms of footwear, including structure provided in the sole of the shoes for allowing the flow of air from outside the shoe to inside the space therewithin, or (as in the case of the Lee patent) for allowing air within the shoe to be exhausted therefrom in use. As can be imagined, care had to be taken with many of these shoes to prevent moisture, dirt and the like from entering the shoe through these ventilation openings in use, and, more importantly, the amount of air flow Provided by these structures was quite limited. The Lee device, in particular, also contemplates the use of mechanical air expiration exhausters which must be carefully fitted within the sole of the shoe, making the construction thereof relatively complex and unwieldy. In practicality, these structures did not Provide appreciable, positive ventilation.

Other attempts at providing ventilation to footwear can be seen in U.S. Pat. Nos. 4,776,110 (which issued to J. Shiang on Oct. 11, 1988), and U.S. Pat. No. 4,835,883 (which issued to E. Tetrault, et al. on June 6, 1989), as well as in the French reference 2,614,510 (filed Apr. 30, 1987). In particular, the Shiang arrangement includes an insole embedded inside a shoe, having an air pumping means in the rear portion of the inside which is activated by the wearer's foot to positively pump air brought into the shoe through a hole formed in the side of the upper portion of the shoe. The air is forced into the front part of the shoe where it is released through a Plurality of perforations formed in the insole of the shoe. A front ventilating hole in the upper portions of the shoe outer is also provided.

Similarly, the Tetrault, et al. shoe includes an associated conduit formed with a check valve for directing ambient air into a ventilating sole formed in the shoe. The ventilating sole includes a plurality of chambers which are separated by generally "V" shaped vane elements which allow movement of air only in a forward direction. Alternate compression and expansion of the insole allows captured air within the various chambers to circulate therewithin and to provide a cushioning effect for the wearer. Likewise the French reference appears to pertain to a structure for providing ventilation to the sole of a shoe, including an air inlet conduit and an air pumping device which might respond to alternate compression by the heel of the wearer's foot to circulate air within the shoe. While these devices attempted to respond to the lack of significant air ventilation provided by the more passive devices discussed above, they are all relatively complex in design and difficult and expensive to manufacture. Moreover, their structures were designed solely to provide for air ventilation within the shoe, were generally not removable or interchangeable, and failed to respond directly to other concerns such as comfort, support, interchangeability, deodorization, and anti-fungus concerns.

Other attempts to provide ventilation to shoes in the form of shoe insoles can be found in U.S. Pat. No. 3,624,930 (which issued to O. Johnson, et al., on Dec. 7, 1971), U.S. Pat. No. 4,224,746 (which issued to S. Kim on Sept. 30, 1980), and U.S. Pat. No. 3,426,455 (which issued to V. Drago on Feb. 11, 1969). The Drago device was contemplated as an insole which was to be bonded to the inner surface of a shoe sole, and included a bottom portion having downwardly facing ribs which increase in depth toward the rear of the insole to provide a wedge-shaped orthopedic insole. The upper layers of the insole are pattern perforated to Provide fluid communication between chambers formed by the ribs on the underside of the insole such that air is periodically expelled from those chambers when the insole is compressed in use. While this compression tends to cause some air movement within the shoe, the amount of ventilation provided by the Drago device is quite limited, and the insole is bonded to the shoe, eliminating convenient removability thereof.

Similarly, the Johnson, et al., insole includes resiliently compressible ribs which face downwardly and rest on the non-porous surface of the sole of the shoe. The ribs are compressed and flattened in response to pressure of the wearer's foot, causing air trapped below the insole to be released upwardly through a plurality of vent holes located near the front portions of the insole. Again, the Johnson insole provides only limited air ventilation within the shoe. The Kim insole includes a resilient member having air inlet holes located near the rear or heel portion, and air outlet or vent holes located near the toe portion of the insole. Kim relies upon the wearer's foot to close off the inlet holes during normal walking activity as downward pressure is applied to the shoe, thereby forcing air trapped within the compressible portion of the insole outwardly adjacent the toe portion of the shoe.

Other ventilated insoles for shoes include pumping devices to provide positive air flow within the shoe. In particular, U.S. Pat. No. 3,225,463 (which issued to C. Burham on Dec. 28, 1965), U.S. Pat. No. 3,475,836

(which issued to H. Braham on Nov. 4, 1969), U.S. Pat. No. 4,633,597 (which issued to J. Shiang on Jan. 6, 1987), and U.S. Pat. No. 4,760,651 (which issued to C. Pon-tzu on Aug. 2, 1988) contemplate shoe insoles having air pump structures included within a compressible insole, and having a check valve to insure movement of air in a particular direction therewithin. Each of these pumping devices relies upon the compressibility of portions of the insole to ultimately draw air into the insole during the noncompressive use periods, thereafter expelling the trapped air through air channels formed within the insole and upwardly through venting perforations to force air circulation within the shoe. Likewise, a shoe advertised under the name Taicher similarly included an insole insert portion having air inlet conduits with one-way check valves to permit the inlet of air into a collection space within the insole during noncompression use periods, with that trapped air being forced upwardly and outwardly into the shoe during compressive use periods.

While the above described, positive air flow ventilating insoles allegedly improve the air circulation within a particular shoe, heretofore there has not been available a readily interchangeable insole insert/shoe system which could simultaneously provide improved comfort for the wearer along with other beneficial features such as positive air ventilation, deodorization, anti-fungus protection, as well as improved blood circulation and support for the wearer's foot. While the prior devices have attempted to address individual ones of these benefits, none have been able to provide a combination of these benefits in a simple and efficient interchangeable structure.

DISCLOSURE OF THE INVENTION

It is an object of this invention to obviate the above-described problems and shortcomings of the shoe insoles and shoe systems available heretofore.

It is also an object of the present invention to provide an improved interchangeable insole for shoes which provides increased comfort and support for the wearer, and offers additional optional benefits previously unavailable in a single structure, in a simple, efficient, and low cost manner.

It is also an object of the present invention to provide an interchangeable insole for shoes which features a ventilating and deodorizing system, along with improved support and foot stimulation features.

In accordance with one aspect of the present invention, there is provided a removable insole for insertion into a shoe, including a substantially impervious flexible base having an overall anatomical shape and an outer periphery. The base further includes a Plurality of upwardly extending compressible support columns each having a central axis and being attached at its lower end to the base. The upper ends of the compressible support columns remain substantially free and unattached. An anatomical pad having a top surface and a bottom surface, and substantially conforming to the peripheral shape of the base is attached to the outer periphery of the base. The pad is, thereby, effectively spaced from the base by the support columns to form a compressible chamber therebetween. In a preferred embodiment, the support columns are free to compress vertically along their central axes and to move laterally in directions normal to such vertical compression in use, thereby providing a massaging or stimulation action to the lower portions of the wearer's foot.

BRIEF DESCRIPTION OF THE DRAWINGS

While the specifications concludes with claims particularly pointing at and distinctly claiming the present invention, it is believed that the same will be better understood from the following description taken in conjunction with the accompanying drawings in which:

of the base of

Figure 1:
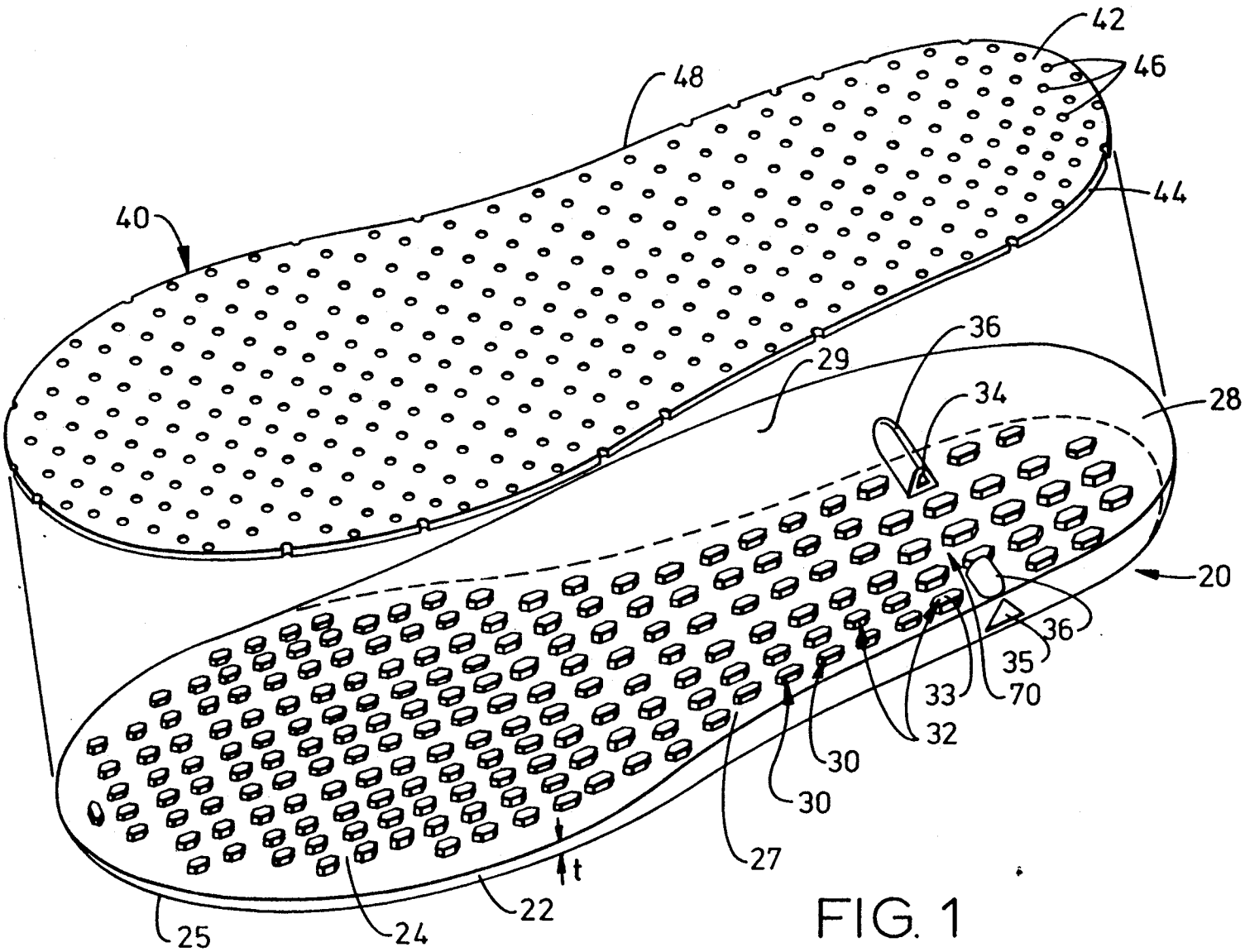
FIG. 1 is an exploded view of a removable insole for a shoe made in accordance with the present invention.
Figure 2:
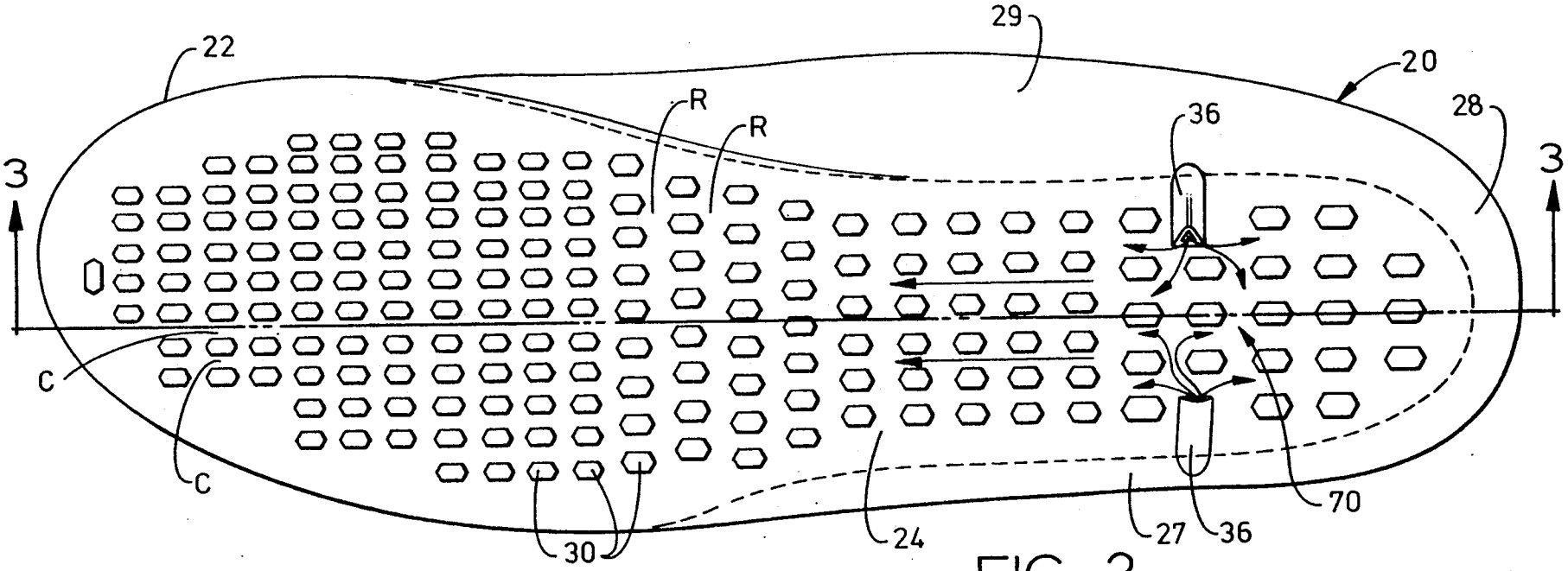
FIG. 2 is a plan view of the base of the insole of FIG. 1.
Figure 3:
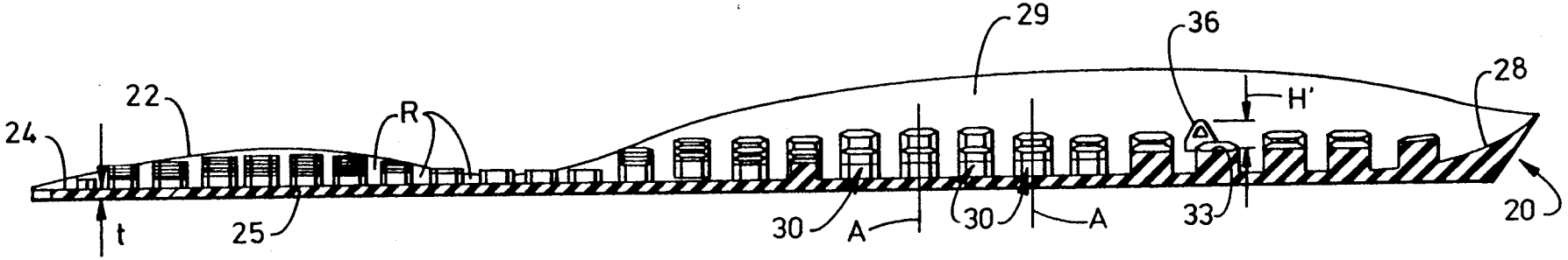
Figure 4:
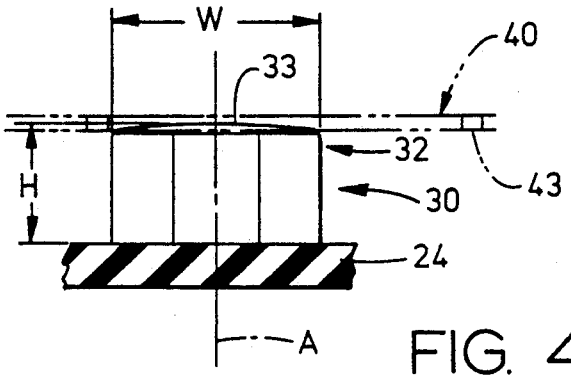
Figure 5:
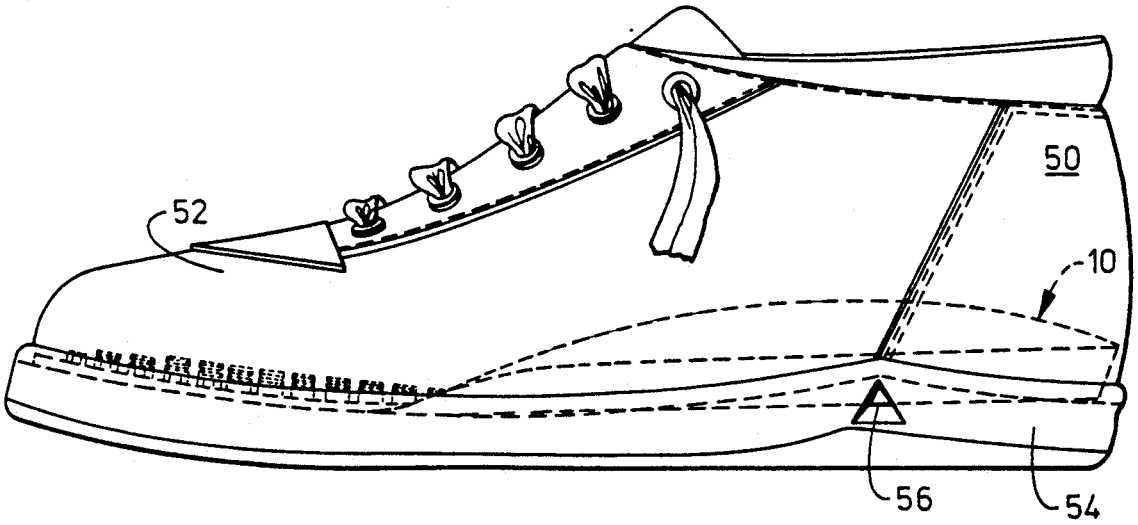
Figure 6:
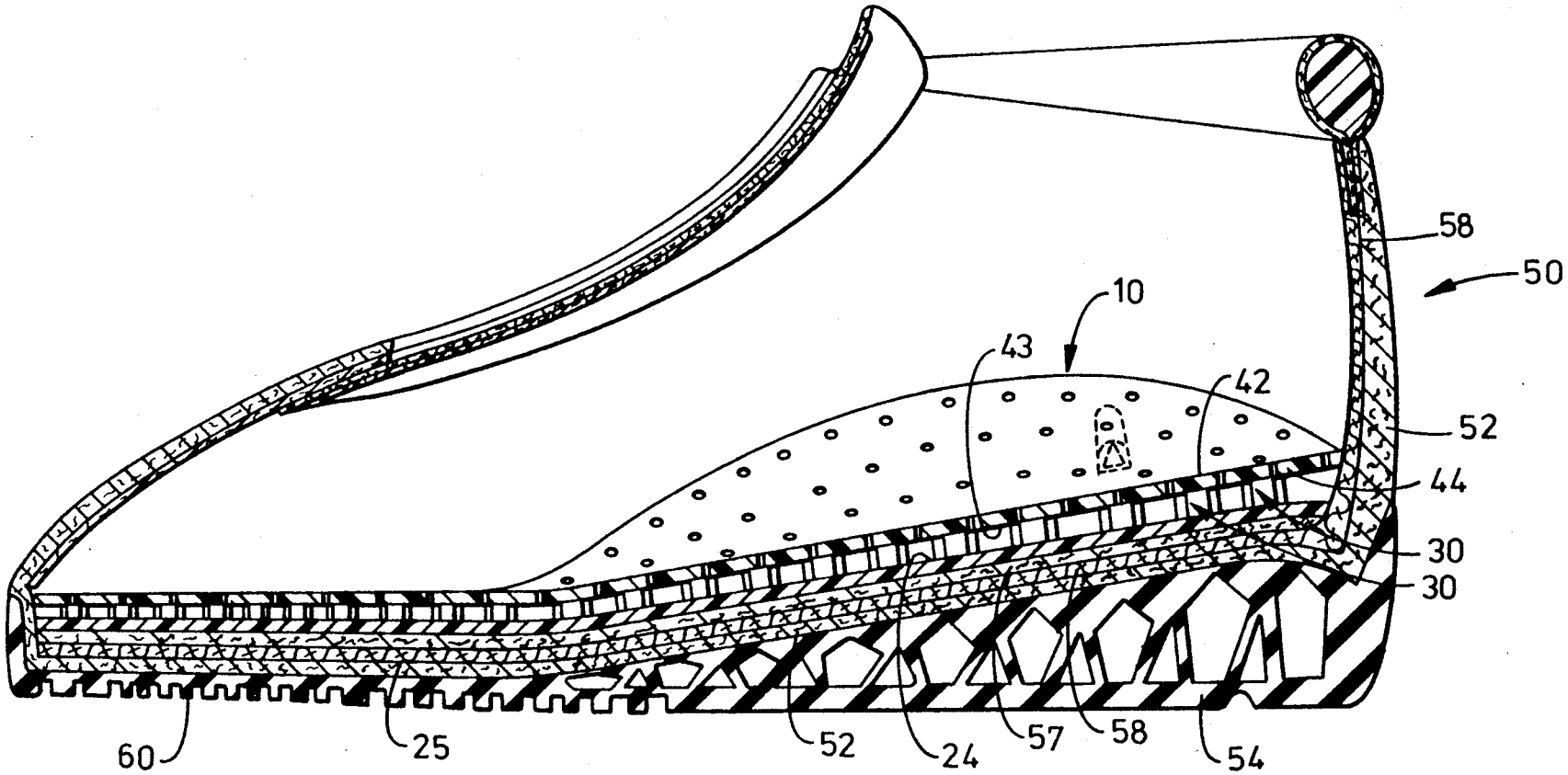
Figure 7:
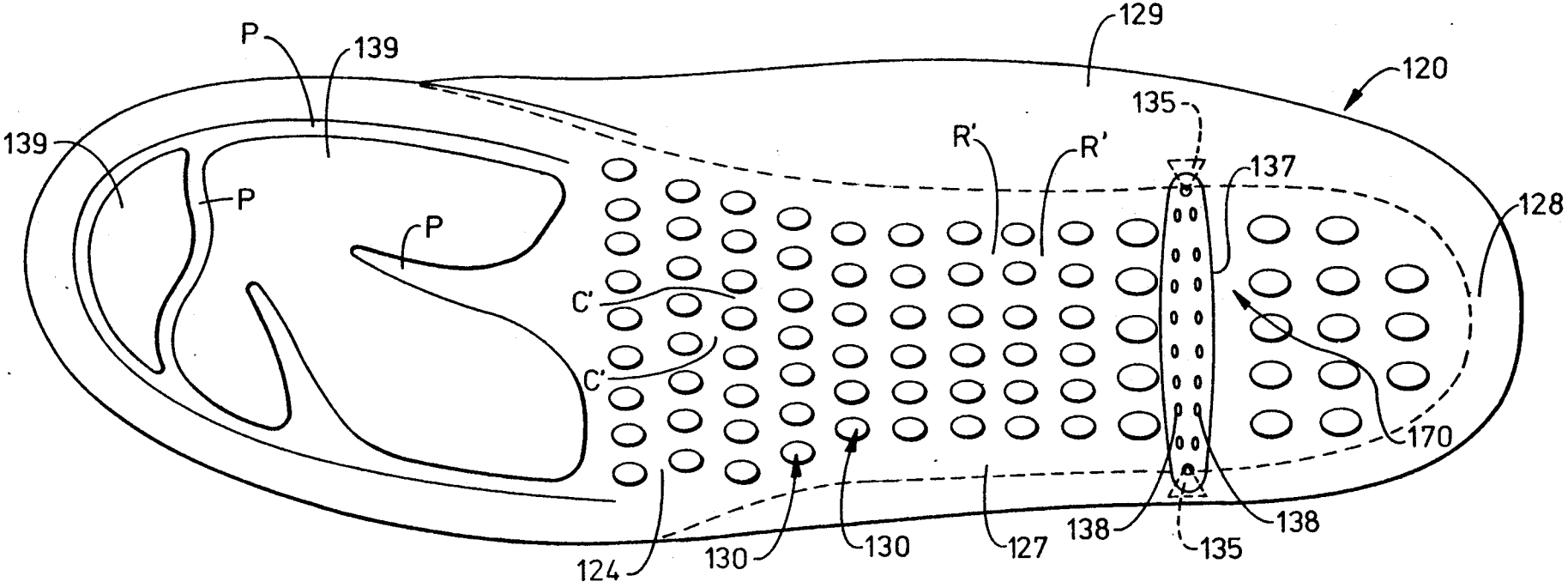

FIG. 3 is a cross-sectional view FIG. 2, taken along line 3—3 thereof;

FIG. 4 is an enlarged side elevational view of a single support column of a shoe insole such as illustrated in FIGS. 1-3, showing additional detail thereof;

FIG. 5 is a perspective view of a shoe fitted with a removable insole such as illustrated in FIG. 1, with the removal insole shown in phantom;

FIG. 6 is a vertical cross-sectional view of the shoe of FIG. 5, illustrating additional details of the removable shoe insole/shoe system of the present invention; and FIG. 7 is a plan view of the base of an alternate embodiment of a removable shoe insole made in accordance with the present invention.

DETAILED DESCRIPTION OF THE INVENTION

Referring now to the drawings in detail, wherein like numerals indicate the same elements throughout the views, FIG. 1 illustrates an exploded view of a removable shoe insole 10 made in accordance with the present invention. In particular, removable insole 10 comprises a substantially impervious flexible base 20 preferably having an overall anatomical shape designed to generally correspond with and support a human foot In particular, it can be seen that flexible base 20 is preferably made with a varying thickness t, being thicker adjacent the rear or heel portions of the insole, and correspondingly thinner near the front or toe portions thereof.

As can also be appreciated from the prospective view of FIG. 1, it is contemplated that base 20 will have an outer periphery 22 generally conforming to the outer shape of the human foot and similarly corresponding to the inner shape of a standard shoe. Adjacent the outer periphery 22 and proximate the heel portion of base 20 is preferably formed a curved anatomical heel portion 28. Formed along the inner medial portion of base 20 is an arch support 27, and an oppositely disposed outer support portion 29. As mentioned, the thickness t of base 20 varies front to rear appropriately to provide a wedge-like overall conformation to enhance impact and shock absorption and overall posture supports, as is well known in the industry.

Integrally attached to the upper surface 24 of base 20 is a plurality of upwardly extending compressible support columns 30. As seen best in FIGS. 1 and 2, it is preferred that support columns 30 be situated and spaced from one another in a free-standing relationship so as to provide a series of rows R and channels C extending laterally and longitudinally along upper surface 24, respectively. As will be seen, these resultant rows R and columns C provide effective passages for ventilating air within insole 10 in use, allowing air to move relatively freely in all directions.

As perhaps best illustrated in FIG. 4, it is contemplated that each upwardly extending compressible support column 30 will have a central axis A oriented in a substantially vertical manner, although the vertical nature of any particular support column 30 is not critical. In fact, it may be preferred that support columns 30 located near the outer periphery of portions of insole 10 (e.g., adjacent the outer periphery of the heel portion 28 of the insole 10, or adjacent arch support 27) might preferably be oriented at an angle inwardly to enhance support provided by insole 10. It should also be noted that support columns 30 are designed with a particular height H and diameter or width W which can be varied as desired. In particular, in order to provide the overall wedge confirmation of base 20 and insole 10, it is preferred that the relative diameter or width W and height H of a particular support column 30 increase from front to rear, as illustrated in the figures.

As will also become apparent herein, the size and shape of support columns 30 can be carefully designed to provide relatively precise amounts of support, shock or impact absorption, and/or stimulation to the wearer's foot, as desired. For example, support columns having smaller diameters or width W and relatively larger heights H provide more flexibility and, consequently, less support. Shorter columns generally provide less impact absorption and less flexibility, while support columns having larger effective diameters (W) will tend to be more supportive and less flexible in nature. Greater space between adjacent free standing columns 30 can also provide more room for substantially unimpeded, independent, lateral flexing of the columns.

Hexagonal columns are illustrated in FIGS. 1–4 as an example of a preferred shape for support columns 30. As indicated, however, size, shape and spacing of columns 30 can be varied to effect a desired "feel" of the insole to the wearer's foot, as well as for providing varying levels of comfort (e.g., soft, firm, extra firm) to match the wearer's preference and the use requirements. As seen in FIG. 4, support columns 30 are attached at their lower ends to the upper surface 24 of base 20. Base 20 also has a lower surface 25 which, as will be seen below, is designed to be placed on the permanently mounted insole piece 57 (often made of regenerated leather or Texon type material widely available in the industry) within a shoe.

Each support column 30 includes an upper end 32 which remains substantially free and unattached, and which includes an upper or contact surface 33. A generally rounded or curvilinear upper surface 33 is illustrated in FIG. 4 as a preferred shape for support columns 30. While such shape is preferred, contact surface 33 might equally be made in a concave or dimpled shape, a bullet tip shape, flat, or any other desirable conformation to achieve various "feels" on the bottom of the wearer's foot. It is the contact surface 33 which will effectively serve to support the wearer's foot in use. A curvilinear shape for contact surface 33 is preferred to provide a relatively comfortable surface which can conform to the varying shapes and irregularities of the human foot at a variety of angles. In particular, as support columns 30 are compressed in use, those columns having relatively large heights H may tend to deform or bend somewhat, thereby contacting the wearer's foot at a different angle and with different intensity then initially encountered. The rounded shape allows substantially uniform support and contact notwithstanding any such deformation, and improves comfort. As will be appreciated, the relatively free character of the upper ends 32 of support columns 30 allows varying deformation and movement of the individual support columns in use, thereby enabling optimum comfort and support at all times. Additionally, the somewhat random deformation and movement of the individual support columns 30 in use also tends to provide a stimulation or "massaging" effect on the wearer's foot. It has been found that this massaging action greatly enhances the comfort experienced by the wearer of the shoe, and may tend to encourage blood circulation and perfusion as well.

As also illustrated in FIGS. 1–3, there may preferably be provided means for permitting the flow of air from outside insole 10 to within insole 10, wherein such means comprises at least one air inlet 35 formed along the outer periphery 22 of base 20. Integrally connected in fluid communication with air inlet 35 is an air inlet valve 36, extending laterally inwardly from air inlet 35 at least a portion of the way towards the center of base 20. In a preferred embodiment, a pair of air inlets 35 and corresponding air inlet valves 36 are provided on opposite sides adjacent the heel portions of insole 10. Air valves 36 are preferably formed as collapsible tubular members which allow air to enter from outside insole 10 when compression forces are removed from insole 10 in use.

In particular, air valves 36 and shoe insole 10, except for pad 40, can be integrally formed of relatively soft, flexible material, such as polyurethane, polypropylene, "TR" material or similar rubber-like material such as available from factories located in Montebelluna, Brescia, Vigevano, Porto San Elpidio (Italy), or similar flexible and impervious materials commonly used in athletic shoes and the like. It is also preferred that the air openings 34 formed within air valves 36 be tapered from a larger effective diameter adjacent the outer periphery 22 of base 20 to their smallest effective diameter at their innermost position to insure that the wearer's foot will easily collapse and seal air valves 36 upon impact of the wearer's heel in use. As will be seen, this collapsible nature allows air to enter into insole 10 when compression forces are removed from the insole in use, while preventing the escape of air through air inlets 35 when compression forces are imposed on the insole, thereby forming effective one-way valves allowing movement of air only in an inward direction. It should be understood that other one-way valving devices could also be used in place of collapsible valves 36.

It is also preferred that air valves 36 have an effective height H' (see FIG. 3) measured upwardly from upper surface 24 which is larger than the largest height H of the surrounding support columns 30, so that when compression forces are imposed on insole 10, air valves 36 will be effectively closed prior to substantial compression of the support columns 30 situated adjacent to heel portion of insole 10. While it is preferred that air valves 36 be integrally formed as a unitary structure with the balance of base 20 for simplicity of manufacture and cost maintenance, other means for permitting the flow of air from the outside of the insole to an air chamber (e.g., air chamber 70) therewithin can be equally substituted.

As illustrated in FIG. 1, it is further contemplated that an anatomical pad or insole sock 40 is to be provided with a shape (e.g. 48) substantially conforming to the outer peripheral shape of base 20. Insole sock 40 preferably will include a top pad surface 42 which may be provided with a layer of absorbent material, and a bottom pad surface 43 which may be provided as a layer 44 of foam rubber or similar shock-absorbing material.

Anatomical pad 40 is also preferably provided with a plurality of ventilation perforations 46, as will be described below. Pad 40 is attached to base 20 along the outer periphery 22 thereof, so that bottom surface 43 of insole pad 40 is effectively spaced from the upper surface 24 of base 20 to form an air chamber 70 therebetween. It is also preferred that insole pad 40 be provided as a substantially impervious layer except for its ventilation perforations 46 in order to confine air within air chamber 70 to enable distribution of ventilating air in a predetermined manner. Additionally, by attaching anatomical pad 40 along only the outer periphery 22 of base 20, many of the individual support columns 30 remain substantially unattached to the bottom surface 43 of pad 40, thereby allowing these support columns to remain free to compress both vertically along their central axes and to move and compress laterally in directions normal to that vertical compression in use.

It will be understood that by insuring that the upper ends 32 of a substantial number of support columns 30 remain unattached to anatomical pad 40, the contact surfaces 33 of a substantial number of the support columns 30 can more readily conform to the overall shape and irregularities of the wearer's foot on an ongoing basis. By providing this relatively unrestricted deformation and movability of the upper ends 32 of individual support columns 30, insole 10 can more easily adapt and conform to the wearer's foot and to particular impact stresses imposed during use, thereby allowing more flexible and comfortable support. As also mentioned above, the unique and relatively unrestricted movement of the individual support columns allows the individual contact surfaces 33 to provide a variable yet comfortable support surface adjacent all areas of the wearer's foot, while providing stimulation or "massaging" at the same time.

FIGS. 5 and 6 illustrate a shoe 50 made in accordance with the subject invention, wherein insole 10 has been inserted for use. Shoe 50 is illustrated as including a shoe upper 52, and outsole 54, and optional vent openings or windows 56 to correspond with the oppositely disposed air inlets 35 formed in insole 10. While insole 10 is generally freely removable from shoe 50, alignment clips (not shown) might be attached to more rigidly (although releasably) maintain air inlets and windows 56 in substantial alignment. As seen best in FIG. 6, insole 10 will generally be situated such that the lower surface 25 of base 20 will rest upon the upper surface of the permanent insole 57, which is generally located above the shoe lining 58 and shoe upper 52 attached to outsole 54. It is preferred that insole 10 would be so designed to fit snugly within shoe 50 such that no additional attachment devices, glue or bonding would be necessary.

In use, as the wearer puts weight on a foot shod by a shoe having the insole 10, as described above, air valves 36 will be compressed to a closed position and air within air chamber 70 will be forced through the spaced columns C and rows R within chamber 70 and then upwardly through the perforated anatomical sock 40 to ventilate the wearer's foot. As mentioned, the upstanding support columns 30 are so situated to effectively provide air flow channels within air chamber 70 through which the pressurized air will be directed as desired into the shoe. As will be understood, the anatomical pad 40 can be perforated in such a way as to direct the ventilation air to particular portions of the shoes (e.g., the toes) to optimize the air circulation and ventilating function. The spacing of the upstanding support columns 30 can be designed to selectively direct ventilating air within the insole and upwardly through the surmounted pad 40.

It is also contemplated that support columns 30 and the upper surface 24 of base 20 can be coated or impregnated with deodorant, disinfectant and/or anti-fungal materials which would be imparted to the air within air chamber 70 as it flows around support columns 30. Support columns 30 could further be formed of varying shapes and with varying surface finishes to optimize the surface area of contact with the ventilating air to provide a desired degree of exposure of that air to the coated or impregnated deodorant, disinfectant or anti-fungal agent.

As also mentioned, the contact surfaces 33 of support columns 30 can be formed with various shapes even within a particular insole to achieve various results such as enhanced blood circulation or varying comfort or "feel" of the insole in use, such as by the use of bullet tips, cup shaped, rounded, rough, smooth or pointed contact surfaces 33. For example, it might be preferred to form the contact surfaces 33 of particular support columns in heavy support areas such as the heel with flatter surfaces, while rounded or bullet tips might be desirable in the arch or toe areas to enhance blood flow or comfort. It can be seen that the support columns 30 are multi-functional in operation and provide virtually unlimited adaptability to provide comfort, massaging effects, support, blood circulation stimulation, deodorization, disinfectant, and anti-fungal treatment to ventilating air in the shoe.

It should also be noted that while the upper ends 32 of support columns 30 and the contact surfaces 33 remain substantially unattached to the bottom surface 43 of anatomical pad 40, particular materials can be used to form the bottom surface 43 of pad 40 to provide a desired frictional interaction between support columns 30 and pad 40. In particular, where a foam-like material is utilized to provide bottom surface 43 of pad 40, such material can provide a certain amount of frictional interaction with contact surfaces 33, thereby providing a predeterminable limit on the overall freedom of movement of the distal ends of support columns 30. In particular, it may be desirable to limit the maximum flexibility of any particular support column 30 or several support columns in a particular area of an insole in order to maintain a predetermined amount of foot support in those particular areas. By attention to the frictional interaction between bottom surface 43 and contact surfaces 33 of individual support columns 30, predetermined limitations on the freedom of movement of any particular support column 30 can be designed into an insole 10. Attention can also be directed to the thickness and softness of the bottom surface 43 to provide or limit the amount of mechanical limitation on the lateral movement of individual columns 30. Soft and/or thick materials will tend to form around the upper end 32 of a support column, inherently limiting its range of movement. In this way, flexibility of support columns 30 can be limited within desired parameters to achieve a preferred level of support, blood circulation stimulation and/or comfort for all particular applications. It is further contemplated that the upper ends 32 of certain support columns 30 could also be attached to the bottom surface 43 in order to customize and limit the flexibility of certain support columns in a predetermined pattern or patterns.

It is contemplated that as a result of the unique adaptability of insoles made in accordance with the present invention, and the ready interchangeability of such insoles in conjunction with almost any shoe, the resulting insole/shoe system of the present invention provides a simple and economic means for customizing applications to almost any need.

FIG. 7 shows an alternate embodiment of an insole made in accordance with the present invention, wherein the air valve is provided as a single tubular valve member 137 which is collapsible in much the same way as the air valves 36 described above. Tubular valve member 137 is provided with a plurality of air openings 138 oriented in a variety of directions to allow the inflow of air through air inlets 135. As described above, downward compression forces of the wearer's foot would tend to collapse tubular vale member 137 and effectively close air inlets 135. Air within chamber 170 would, thereafter, be forced through the air channels formed by rows R' and columns C' provided by the spaced individual support columns 130 for disbursal through ventilation perforations in an anatomical pad (not shown) as described above. It should also be noted that support columns 130 are shown as having a generally elliptical cross-sectional conformation. These shapes are shown only as another example of the relatively unlimited shapes which can be utilized for support columns of the present invention.

Insole base 120 of FIG. 7 is also illustrated with a modified front or toe portion, wherein large compressible support areas 139 are provided to support the ball of the wearer's foot. Compressible support areas 139 are interspersed with relieved areas forming passageways or channels P to direct the flow of air to predetermined areas of the toe portion of the shoe. This structure is shown as an alternate, preferred means of directing the air flow within air chamber 170 of an insole 120 to particular portions of the shoe for ventilation purposes. Similarly, insole base 120 of FIG. 7 could be unitarily formed as a single piece of flexible, impervious material. Additionally, as with insole 10 described above, the support columns 130, as well as the upper surface 124 and compressible support areas 139 could be coated or impregnated with appropriate materials for deodorizing, disinfecting, and/or providing anti-fungal treatment to air within air chamber 170 as it is pumped into the shoe through an anatomical sock (not shown) attached to base 120.

Arch support 127, heel portion 128, and outer support portion 129 are identified on base 120 illustrated in FIG. 7 as corresponding to those same structures (i.e. elements 27, 28 and 29) identified above with regard to insole 10.

It should also be noted that the insole of the present invention can provide advantages in comfort, support and enhanced stimulation and blood flow circulation with or without the optional air ventilation features. For example, an insole as shown in FIGS. 1-3 could be provided without air inlets 35 and air valves 36 without losing the unique advantages of the upwardly extending support columns 30 and their unique interaction with anatomical sock 40 and the wearer's foot in use. However, it is preferred to provide a removable insert with all of the structural advantages of the present invention to provide the most functional and comfortable support.

Having shown and described the preferred embodiments of the present invention, further adaptions of the removal insole/shoe system described herein can be accomplished by appropriate modifications by one of ordinary skill in the art without departing from the scope of the present invention. Several of such potential modifications have been mentioned, and others will be apparent to those skilled in the art. Accordingly, the scope of the present invention should be considered in terms of the following claims and is understood not to be limited to the details of structure and operation shown and described in the specification and drawings.

I claim:

1. A shoe and ventilated insole system, said system comprising:

an anatomically designed shoe having an outsole, an upper, an interior portion, and at least one air ventilation opening formed in said upper; and an insole assembly for insertion into said shoe, said assembly comprising, (a) a base having a substantially impervious bottom walls and an outer periphery, said base being substantially anatomical in design to conform generally to the shape of the bottom of a human foot, and said base further comprising a plurality of upwardly extending compressible support columns, each having a central axis and being attached at its lower end to said base, and wherein the upper ends of a substantial number of said support columns remain substantially free and unattached;

(b) an anatomical pad having a top surface and a bottom surface, said pad substantially conforming to the outer periphery of said base, said bottom surface being attached to said base along said outer periphery, and being effectively spaced from said base by said upwardly extending support columns to form a compressible chamber therebetween; and (c) means for permitting the flow of air from outside the insole to said chamber, said means for permitting the flow of air comprising at least one collapsible vent in the outer periphery of said base, said vent permitting inflow of air into said chamber when there is no downward compression force on said insole, and obstructing flow of air out of said chamber through said vent when compression forces are imposed on said insole and being generally alignable with said air ventilation opening.

2. A ventilated insole assembly for use in a shoe, said insole comprising:

(a) a base having a substantially impervious bottom wall and an outer periphery, said base being substantially anatomical in design to conform generally to the shape of the bottom of a human foot, and said base further comprising a plurality of upwardly extending compressible support columns, each having a central axis and being attached at its lower end to said base, and wherein the upper ends of a substantial number of said support columns remain substantially free and unattached;

(b) an anatomical pad having a top surface and a bottom surface, said pad substantially conforming to the outer periphery of said base, said bottom surface being attached to said base along said outer periphery, and being effectively spaced from said base by said upwardly extending support columns to form a compressible chamber therebetween; and (c) means for permitting the flow of air from outside the insole to said chamber, said means for permitting the flow of air into said air chamber comprising a pair of collapsible vents integrally formed in the outer periphery of said base, said vents being oppositely disposed adjacent the heel portion of the base and extending inwardly from the outer periphery thereof.

3. A shoe and ventilated insole system, said system comprising:

an anatomically designed having an outsole; and a ventilated insole, said insole further comprising, (a) a base having a substantially impervious bottom wall and an outer periphery, said base being substantially anatomical in design to conform generally to the shape of the bottom of a human foot, and said base further comprising a plurality of upwardly extending compressible support columns, each having a central axis and being attached at its lower end to said base, and wherein the upper ends of a substantial number of said support columns remain substantially free and unattached;

(b) an anatomical pad having a top surface and a bottom surface, and said pad substantially conforming to the outer periphery of said base, said bottom surface being attached to said base along said outer periphery, and being effectively spaced from said base by said upwardly extending support columns to form a compressible chamber therebetween; and (c) means for permitting the flow of air from outside the insole to said chamber, said means for permitting the flow of air comprising at least one collapsible vent in said outer periphery of said base to permit inflow of air into said chamber when there is no downward compression force on said insole, and obstructing flow of air out of said chamber through said vent when compression forces are imposed on said vent.

4. A ventilated insole for insertion into a shoe, said insole comprising:

(a) a substantially impervious flexible base having an overall anatomical shape and an outer periphery, said base further comprising a plurality of upwardly extending compressible support columns, each having a central axis and being attached at its lower end to the base, with the upper ends of the compressible support columns being substantially free;

(b) an anatomical pad having a top surface and a bottom surface, said pad substantially conforming to the peripheral shape of said base, the bottom surface of said pad being attached to said base along said outer periphery, said pad being effectively spaced from said base by said support columns to form a compressible chamber therebetween; and (c) means for permitting the flow of air from the outside of the insole to said chamber, said means for permitting air flow comprising at least one collapsible vent formed in the outer periphery of said base, said vent permitting inflow of air into said chamber when there is no downward compression forces on said insole, and obstructing flow of air out of said chamber through said vent when compression forces are imposed on said insole.

5. The insole of claim 4, wherein said support columns each further comprise an upper support surface anatomically designed to substantially conform to a wearer's foot, and wherein a substantial number of said support columns remain substantially unattached to the bottom surface of said pad, whereby said support columns are free to compress vertically along their central axes, and to move laterally in directions normal to such vertical compression in use.

6. The insole of claim 5, wherein said upper support surfaces are generally rounded in confirmation.

7. The insole of claim 5, wherein said pad further comprises a plurality of ventilation openings in fluid communication with said chamber for permitting flow of air outwardly from said insole when compression forces are imposed on said insole.

8. The insole of claim 4, wherein said vent comprises a substantially tubular structure formed adjacent the heel portion of said base, said tubular structure extending inwardly from the outer periphery of said base, in a tapered fashion, and being collapsible in response to compressive forces imposed on said insole to effectively prevent outward flow of air from said chamber through said vent.

9. The insole of claim 4, wherein said means for permitting the flow of air into said chamber comprises a pair of vents integrally formed with said base, said vents being oppositely disposed adjacent the heel portion of the base and extending inwardly from the outer periphery thereof.

10. The insole of claim 4, wherein said vent comprises a substantially tubular structure formed adjacent the heel portion of said base, said tubular structure extending across the heel portion of said base between oppositely disposed portions of the outer periphery, said tubular structure including a plurality of vent openings capable of placing the chamber in fluid communication with the ambient outside of said insole, and being collapsible in response to compression forces imposed on said insole to effectively prevent outward flow of air from said chamber through said vent.

11. The insole of claim 4, wherein the substantially free upper ends of said support columns may flex and move in lateral directions relative their central axes during application of compression forces to said insole, thereby providing enhanced absorption of shock forces and massaging action to the wearer's foot in use.

12. The insole of claim 11, wherein the bottom surface of said pad contacts the upper ends of said support columns, thereby effectively limiting the movement of said free ends of said support columns in lateral directions and controlling the massaging action thereof during application of compression forces to said insole.

13. A removable insole assembly for insertion into shoe, comprising:

(a) a base having a substantially impervious bottom wall and an outer periphery, said base being substantially anatomical in design to conform generally to the shape of the bottom of a human foot, and said base further comprising a plurality of upwardly extending compressible support columns, each having a central axis and being attached at its lower end to said base, and wherein the upper ends of a substantial number of said support columns remain substantially free and unattached;

(b) an anatomical pad having a top surface and a bottom surface, said pad substantially conforming to the outer periphery of said base, said bottom surface being attached to said base along said outer periphery, and being effectively spaced from said base by said upwardly extending support columns to form a compressible chamber therebetween; and (c) means for permitting the flow of air from outside the insole to said chamber comprising at least one collapsible vent formed in said outer periphery of said base, said vent permitting inflow of air into said chamber when there is no downward compression force on said insole, and obstructing flow of air out of said chamber through said vent when compression forces are imposed on said insole.

14. The insole of claim 13, wherein said vent comprises a substantially tubular structure formed adjacent the heel portion of said base, said tubular structure extending inwardly from the outer periphery of said base, in a tapered fashion, and being collapsible in response to compressive forces imposed on said insole to effectively prevent outward flow of air from said chamber through said vent.

15. The insole of claim 13, wherein said support columns are coated to provide treatment characteristics to air flowing into said air chamber.

16. The insole of claim 13, where said support columns are impregnated with a substance to provide treatment characteristics to air flowing into said air chamber.

* * * * *